United States Patent [19]

Kanchev

[11] 4,383,139

[45] May 10, 1983

[54] ELECTROSTATIC ACOUSTIC CONVERTER

[75] Inventor: Peter K. Kanchev, Sofia, Bulgaria

[73] Assignee: Bulgarsko Radio, Sofia, Bulgaria

[21] Appl. No.: 239,346

[22] Filed: Mar. 2, 1981

[51] Int. Cl.[3] ..... H04R 19/00

[52] U.S. Cl. ..... 179/111 R; 179/181 R

[58] Field of Search ..... 179/111 R, 111 E, 106, 179/181 R

[56] References Cited

U.S. PATENT DOCUMENTS 3,345,469 10/1967 Rod ..... 179/111 R 3,935,397 1/1976 West ..... 179/111 R

*Primary Examiner*—Benjamin R. Fuller

[57] ABSTRACT

An electrostatic acoustic converter having two sound transparent electrodes between which a plastic membrane covered with a conductive layer is disposed. The membrane is fixed between two identical insulating plates having openings therethrough, in its greater part each of the insulating plates is coated with an electrically conductive layer which comes into contact with the conductive layer of the membrane and with a metal track with terminals. The metal track is fixed on an insulating card around a centrally situated metal plate having a terminal. The metal plate is multi-perforated and constitutes a sound transparent electrode.

4 Claims, 4 Drawing Figures

ELECTROSTATIC ACOUSTIC CONVERTER

This invention relates to an electrostatic acoustic converter, applicable to loudspeakers and earphones.

An electrostatic acoustic converter applied to electrostatic earphones is known. Such known converter has a conductive plastic membrane stretched over a conductive ring; there are insulating bodies with sound transparent electrodes pressed against both sides of the membrane, such bodies being insulating disks with contral openings in which metal nets are fixed.

This converter has the following disadvantages: in the first place, it is difficult to bring out reliable electric connections from the sound transparent electrodes and the conductive layer of the plastic membrane since the contacting area is insufficient.

In the second place, the metal nets and the central openings of the insulating disks should be fixed with great precision, which is hard to achieve.

Furthermore, the stretching of the membrane over the conductive ring is an operation that is hard to carry out and control in production.

The object of the present invention is to create an electrostatic acoustic converter safeguarded against high voltage, which converter can ensure a reliable electric coupling with the electrodes and the membrane, and which has a simplified construction.

This object is achieved by the fixation of the plastic membrane of the electrostatic acoustic converter comprising two sound transparent electrodes between two identical insulating plates with oval openings, fixed to each other by means of epoxide resin rivets. Each of the openings is in its greater part peripherally coated with a conductive layer which comes into contact with the conductive layer of the membrane and with a metal track with terminals. The metal track is fixed on an insulating card around a centrally situated metal layer or plate with a terminal in which through holes are perforated, which plate represents the sound transparent electrode. The reverse side of the insulating card is completely metallized. The two insulating cards are coupled by means of metal strips, peripherally situated on them, and through soldering with a metal solder.

The advantages of the electrostatic acoustic converter in accordance with the invention are: reliable and facile realization of electric tappings from the conductive coating of the membrane and the sound transparent electrodes; facilitated setting-up of the converter; increased electrical safety.

A preferred embodiment of an electrostatic acoustic converter according to the invention is shown in the following figures, wherein.

Figure 1:
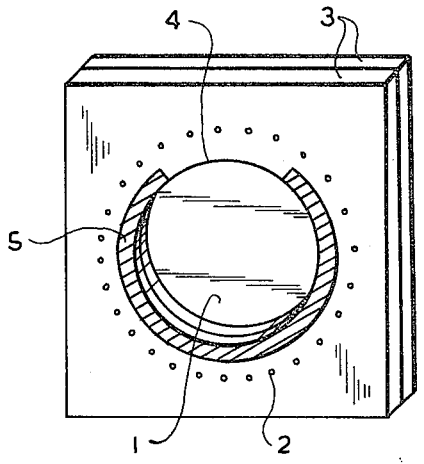
FIG. 1 is a view in perspective of a plastic membrane fixed between two insulating plates.

A plastic membrane 1 is fixed between two identical insulating plates 3, bound together through resin rivets 2, which plates have centrally situated openings 4 (FIG. 1). The membrane 1, the edges of the openings 4 and part of the surface of the insulating plates 3 are covered with an electrically conductive layer 5 which is interrupted at the top.

Figure 2:
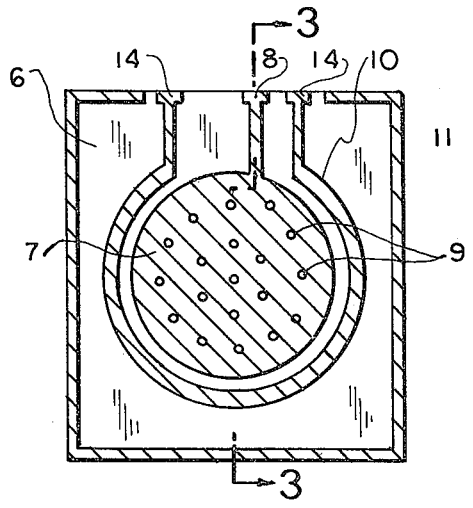
FIG. 2 is a view in vertical section through an insulating card, showing the central metal oval plane with through holes, the metal track and the peripheral metal strips which are fixed upon the card.
Figure 3:
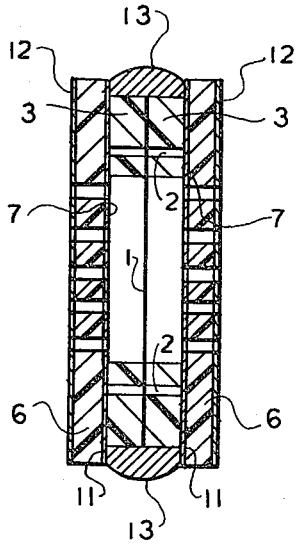
FIG. 3 is a longitudinal section of the electrostatic acoustic converter, the section being taken along the line 3—3 in FIG. 2.

On one side of insulating cards 6 (FIG. 4) there is a centrally fixed metal plate 7 with a terminal 8 (FIG. 2); plate 7 is perforated by through holes 9. This plate represents the sound-transparent electrode. Around the metal plate 7 there is disposed a metal track 10 with a terminal 14. On the periphery of the insulating card 6 a metal strip 11 is fixed (FIG. 2). The reverse side of the insulating card 6 is covered with a metal layer 12 (FIG. 3).

The two insulating plates 3 (FIG. 3) with the plastic membrane 1 between them are pressed between two insulating cards 6 in such a way that the conductive layer laid upon the membrane 1 and the conductive layer 5 upon a part of the surface of the insulating plates 3 come into electrical contact with the metal track 10 of the insulating cards 6. The insulating cards 6 of the electrostatic acoustic converter are connected through tin solder 13 which binds the peripheral metal strips 11 together. The insulating plates 3 serve to maintain the membrane 1 in stretched condition, to ensure the electric coupling with the membrane and to keep the membrane 1 and the metal plates 7 apart. The metal tracks 10 with terminals 14 serve to insure the electric connection between the conductive layers 5 upon the insulating plates 3 and the membrane 1, and the external source of polarizing voltage (which is not shown in the figure).

The voltage from the source of an audio signal is applied between the metal plates 7 each with a terminal 8, the plates serving as immovable electrodes of the converter. The metal layer 12 of the insulating card 6 may be connected to ground, and serves as a protecting electrostatic screen.

Figure 4:
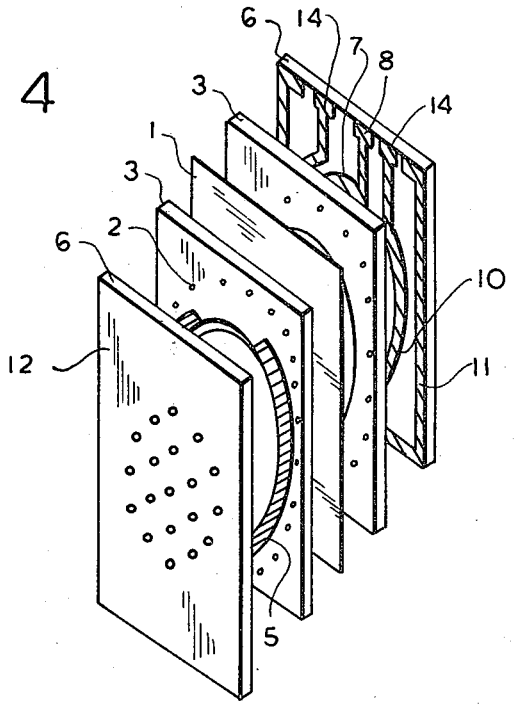
FIG. 4 is an exploded view in perspective of the electrostatic acoustic converter.

In the exploded view of the electrostatic acoustic converter shown in FIG. 4, the central openings through members 1 and 3 are oval in shape.

The electrostatic acoustic converter functions in the following way: The plastic membrane 1 hanging freely, moves cophasally with the electric field created by the two sound-transparent electrodes and formed between the metal plates 7. The distance between the electrodes and the membrane 1 is fixed by the insulating plates 3.

Although the invention is illustrated and described with reference to one preferred embodiment thereof, it is to be expressly understood that it is in no way limited to the disclosure of such preferred embodiment but is capable of numerous modifications within the scope of the appended claims.

I claim:

1. In an electrostatic acoustic converter having two sound transparent electrodes between which there is disposed a plastic electrically conductive membrane, the improvement wherein the membrane is fixed between two insulating plates having central oval-shaped openings therethrough, each of the insulating plates being partly coated with an electrically conductive layer which contacts the electrically conductive membrane, two identical insulating cards disposed outwardly of each of the insulating plates, a metal plate with a terminal being disposed on the sides of the insulating cards confronting the respective insulating plates, said metal plates overlying the central openings through the insulating plates, and a metal track on the said cards spaced radially outwardly of the metal plates, the metal plates and the metal tracks each being provided with a terminal, the metal plates being multi-perforated and constituting sound transparent electrodes.

2. An electrostatic acoustic converter according to claim 1 wherein the insulating plates are joined together by rivets.

3. An electrostatic acoustic converter according to claim 1, wherein the other side of at least one of the insulating cards is covered with a metal layer to serve as a grounding connection.

4. An electrostatic acoustic converter according to claim 1, wherein the insulating cards are bound together by means of metal strips peripherally situated on them and by metal solder connecting the metal strips.

* * * * *